US011078754B2

(12) United States Patent
Telfer et al.

(10) Patent No.: US 11,078,754 B2
(45) Date of Patent: Aug. 3, 2021

(54) DOWNHOLE TEST TOOL AND METHOD OF USE

(71) Applicant: ARDYNE HOLDINGS LIMITED, Aberdeen Aberdeenshire (GB)

(72) Inventors: George Telfer, Aberdeen (GB); Alan Fairweather, Aberdeenshire (GB); Michael Wardley, Aberdeen (GB); James Linklater, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 60 days.

(21) Appl. No.: 16/340,325

(22) PCT Filed: Oct. 9, 2017

(86) PCT No.: PCT/GB2017/053044
§ 371 (c)(1),
(2) Date: Apr. 8, 2019

(87) PCT Pub. No.: WO2018/069683
PCT Pub. Date: Apr. 19, 2018

(65) Prior Publication Data

US 2019/0257193 A1 Aug. 22, 2019

(30) Foreign Application Priority Data

Oct. 10, 2016 (GB) ..... 1617202
Feb. 23, 2017 (GB) ..... 1702897

(51) Int. Cl.
*E21B 34/12* (2006.01)
*E21B 23/00* (2006.01)
(Continued)

(52) U.S. Cl.
CPC ..... *E21B 34/12* (2013.01); *E21B 23/00* (2013.01); *E21B 23/01* (2013.01); *E21B 23/04* (2013.01);
(Continued)

(58) Field of Classification Search
CPC .... E21B 47/117; E21B 33/1285; E21B 34/12; E21B 23/01; E21B 33/1204;
(Continued)

(56) References Cited

U.S. PATENT DOCUMENTS 3,223,169 A * 12/1965 Roark ..... E21B 33/12955 166/120
3,739,849 A * 6/1973 Meripol ..... E21B 23/01 166/216
(Continued)

FOREIGN PATENT DOCUMENTS

CA 2834059 C 2/2016
EP 0504848 A1 9/1992
(Continued)

OTHER PUBLICATIONS

International Search Report dated Jan. 17, 2018 for PCTGB2017/053047.
(Continued)

*Primary Examiner* — Michael R Wills, III
(74) *Attorney, Agent, or Firm* — Law Office of Jesse D. Lambert, LLC

(57) ABSTRACT

A well bore integrity test tool (10) and method of pressure integrity testing a well bore by performing positive and negative pressure tests in a well bore in multiple locations in the well and on the same trip as other operations in the well bore. The tool includes a resettable anchor mechanism (20) and a tension set packer assembly (22). An embodiment of
(Continued)

performing a dress-off, integrity testing, casing cutting and pulling in a single trip for well abandonment is described.

18 Claims, 10 Drawing Sheets

(51) Int. Cl.

| | |
|---|---|
| ***E21B 33/128*** | (2006.01) |
| ***E21B 23/01*** | (2006.01) |
| ***E21B 33/129*** | (2006.01) |
| ***E21B 23/04*** | (2006.01) |
| ***E21B 33/12*** | (2006.01) |
| ***E21B 29/00*** | (2006.01) |

(52) U.S. Cl.
CPC ..... *E21B 29/005* (2013.01); *E21B 33/1204* (2013.01); *E21B 33/1285* (2013.01); *E21B 33/1291* (2013.01); *E21B 2200/06* (2020.05)

(58) Field of Classification Search
CPC .. E21B 33/1291; E21B 23/04; E21B 2200/06; E21B 23/00; E21B 23/06; E21B 29/005; E21B 29/08; E21B 31/16; E21B 31/20
See application file for complete search history.

(56) References Cited

U.S. PATENT DOCUMENTS

| | | | | |
|---|---|---|---|---|
| 3,826,307 | A | 7/1974 | Brown et al. | |
| 4,678,035 | A | 7/1987 | Goldschild | |
| 5,101,895 | A | 4/1992 | Gilbert | |
| 5,141,053 | A | 8/1992 | Restarick et al. | |
| 6,896,064 | B2 | 5/2005 | Howlett et al. | |
| 7,510,016 | B2 * | 3/2009 | Telfer | E21B 33/128 166/387 |
| 7,546,876 | B2 | 6/2009 | McAfee | |
| 7,802,949 | B2 | 9/2010 | Fuhst et al. | |
| 2001/0050172 | A1 * | 12/2001 | Tolman | E21B 17/203 166/297 |
| 2003/0201102 | A1 | 10/2003 | Mackenzie et al. | |
| 2006/0272828 | A1 * | 12/2006 | Manson | E21B 23/006 166/387 |
| 2007/0221372 | A1 | 9/2007 | Telfer | |
| 2010/0186495 | A1 | 7/2010 | Bekkeheien | |
| 2012/0055681 | A1 | 3/2012 | Telfer | |
| 2012/0132438 | A1 | 5/2012 | Telfer | |
| 2012/0175108 | A1 | 7/2012 | Foubister et al. | |
| 2013/0048568 | A1 | 2/2013 | Crow et al. | |
| 2013/0168087 | A1 | 7/2013 | Linklater et al. | |
| 2016/0265295 | A1 | 9/2016 | Plante et al. | |

FOREIGN PATENT DOCUMENTS

| | | | |
|---|---|---|---|
| EP | 0554013 | A1 | 8/1993 |
| GB | 2280461 | A | 2/1995 |
| GB | 2461639 | A | 1/2010 |
| GB | 2535311 | A | 8/2016 |
| WO | 2005106189 | A1 | 11/2005 |

OTHER PUBLICATIONS

International Search Report dated Jan. 26, 2018 for PCT/GB2017/053044.

* cited by examiner

DOWNHOLE TEST TOOL AND METHOD OF USE

The present invention relates to a well bore integrity test tool and method of use, and in particular, though not exclusively, to positive and negative integrity pressure test tools for application in well bore plugging and abandonment operations.

BACKGROUND TO THE INVENTION

During the construction of an oil or gas well, a hole is drilled to a pre-determined depth. The drilling string is then removed and a metal tubular or casing is run into the well and is secured in position using cement.

Once the casing is cemented and set in position in the well bore, the well bore may be drilled to a deeper depth by lowering a drill down the casing. Further strings of casing may be cemented into place in the well bore. This process of drilling, running casing and cementing is repeated with successively smaller drilled holes and casing sizes until the well reaches its target depth. At this point, if required, a liner comprising similar tubular sections coupled together end-to-end may be installed in the well, coupled to and extending from the final casing section. This coupling is provided at the liner top via a hanger as is known in the art.

Over time, which may be several decades, the production of hydrocarbons reduces until the production rate is no longer economically viable, at which point the well has reached the end of its productive life. The well is plugged and abandoned.

To plug and abandon the well bore the annulus between the surface and casing/liner strings must be sealed. It is necessary to test the integrity of the casing and the cement bonds to ensure the well bore is adequately sealed and production fluids do not leak into the surrounding environment.

Testing the integrity of the tubulars and cement bonds is known during drilling of the well when the tubulars and cement are initially located in the well bore. For this, downhole packers are used to seal off sections of a pre-formed well bore in order to test the integrity of the particular section of bore. One test carried out to identify any such irregularities is a so-called "in-flow" or "negative" test. During an in-flow test a packer is included on a work string and run into a bore. The individual packer elements of the packer tool are expanded to seal the annulus between the well tubing (casing or lining) and tool in the well bore. Expansion or "setting" of the packer is usually achieved by rotating the tool relative to the work string and the set packer thereafter prevents the normal flow of drilling fluid in the annulus between the work string and well bore tubular. A lower density fluid is then circulated within the work string which reduces the hydrostatic pressure within the pipe. As a consequence of the drop in hydrostatic pressure, well bore fluid can flow through any cracks or irregularities in the lining of the well bore into the annulus of the bore. If this occurs, the flow of well bore fluid into the bore results in an increase in pressure which can be monitored. As a result it is possible to locate areas where fluid can pass into the well bore through irregularities in the structure of the bore and where repair of the lining may be required. After testing, the bore may be "pressured up" to remove the well bore fluid from the bore and a heavy drilling fluid can be passed through the string to return the hydrostatic pressure to normal.

Typically, a separate trip is required to be made into the well to perform an in-flow or negative pressure test. This is because the conventional packer tools used are set by a relative rotation within the well bore. As many other tools are activated by rotation and indeed as the drill string itself would normally be rotated during this type of operation, it is likely that the packer would prematurely set. This problem has been overcome by the introduction of a weight-set packer, also referred to as a "compression-set packer", and such a tool is disclosed in US 2013/0168087. This provides a downhole packer for providing a seal in a well bore to allow integrity testing of well bore with drill ahead capability immediately thereafter has a disengageable packer assembly wherein the packer element may be rendered disengageable by mounting the packer to the string using a tool body provided with a sleeve bearing a packer element, wherein the body is initially restrained from movement within the sleeve by engagement of an internal selectively movable retaining element. A method of testing a well bore with follow on drilling after disengaging the packer element is described.

While US 2013/0168087 provides the advantage of having the ability to perform an integrity test and drill on a single trip in the well bore, the packer must land on the liner top to operate. This has disadvantages in placing significant weight upon the liner top and limits the integrity test to being performed over tubular located directly at and immediately below the liner top. While this is the required location for integrity testing during the drilling phase of a well, in plugging and abandonment this severely limits the sections over which integrity testing can be performed. Additionally, due to corrosion and possible tubular distortion on the liner top during the life of the well, setting down weight at this point may introduce leak paths thereby negating the use of the integrity test.

SUMMARY OF THE INVENTION

It is an object of the present invention to provide a robust and reliable integrity testing tool suitable for deployment downhole which is capable of performing positive pressure testing and/or negative inflow testing at multiple locations within the well bore, while allowing rotation through the tool to operate tools located below.

It is a further object of an embodiment of the present invention to provide an integrity testing tool which allows integrity testing to be performed on the same run in a well bore as drilling.

It is a still further object of the present invention to provide a method of integrity testing at multiple locations in a well bore.

Further aims of the invention will become apparent from the following description.

According to a first aspect of the invention there is provided a downhole integrity testing tool comprising:

a substantially cylindrical assembly having first and second ends adapted for connection in a work string;

an anchor mechanism configured to grip a section of tubular in a well bore; and a packer assembly being settable to create a seal between the tool and the tubular to thereby allow the flow of fluids into a sealed area to perform an integrity test;

wherein the anchor mechanism is resettable and the tool is configured to operate in:

a first configuration wherein the anchor mechanism and the packer assembly are unset so that rotation of the work string is transmitted through the tool;

a second configuration wherein the anchor mechanism is set to grip the tubular and the packer assembly is unset so that fluid may be circulated through the tool without movement of the tool; and a third configuration wherein the anchor mechanism and the packer assembly are both set in order to perform an integrity test.

By providing an anchor mechanism that is capable of being set at different axial positions in the well bore the integrity testing tool may be anchored at different axial positions in the well bore. This may facilitate integrity testing to be performed at different axial positions in the well bore, casing and/or downhole tubular. This may allow the identification of leaks and an assessment of cement bonds which hold the well bore, casing or downhole tubular in place.

Preferably, the anchor mechanism is located below the packer assembly when positioned in the work string. In this way, tension can be applied to set the packer assembly by virtue of the anchor mechanism.

Preferably, in the first configuration rotation of the work string is transmitted through the tool. In this way a tool such as a cutter can be operated below the anchor mechanism with the anchor mechanism set to stabilise and support operation of the tool.

The anchor mechanism may be configured to be reversibly set at different axial positions in the well bore.

Preferably the integrity testing tool has a tool body. The tool body may have a through bore. Preferably the integrity testing tool is configured to perform negative and/or positive integrity testing.

Preferably the anchor mechanism comprises a cone and at least one slip. The cone may be circumferentially disposed about a section of the integrity testing tool.

Preferably, the at least one slip is configured to engage an inner surface of the well bore, casing or downhole tubular. Preferably, the at least one slip is configured to engage an inner diameter of a section of the well bore, casing or downhole tubular. The at least one slip may bear against the cone to engage the well bore, casing or downhole tubular.

Preferably the cone has a slope. The slips may travel along the slope of the cone so that the slips extend from the tool body to engage and grip the well bore, casing or downhole tubular.

Preferably the integrity testing tool may be positioned in a casing and/or tubular located in a well bore. Integrity testing may be performed to assess the integrity of the well bore, casing and/or downhole tubular. Integrity testing may be performed to assess the integrity cement plugs located in the well bore, casing and/or downhole tubular. Integrity testing may be performed to assess the integrity of cement bonds which hold the casing and/or downhole tubular in the well bore.

The anchor mechanism may comprise a first sleeve configured to be slidably mounted within the tool body. The first sleeve may be configured to move the at least one slip between a first position where the at least one slip does not engage the casing and a second position where the at least one slip engages the casing.

The anchor mechanism may be hydraulically or pneumatically actuated. The anchor mechanism may be actuated by pumping fluid into the tool. The anchor mechanism may be actuated by pumping fluid into a bore in the tool.

The anchor mechanism may be actuated by pumping fluid into a bore in the tool above a pre-set flow rate threshold. The sleeve of the anchor mechanism may be configured to move in response to fluid pressure acting on the sleeve or at least part of the sleeve.

The flow rate threshold may be set by changing the spring force acting on the sleeve. The anchor mechanism and the packer may be axially spaced apart on the downhole tool. The flow rate threshold may range from 50 to 500 gpm. Preferably the flow rate threshold is 250 gpm.

By providing an anchor mechanism capable of being hydraulically or pneumatically actuated the anchor mechanism may be actuated at any axial position in the well bore and may facilitate the tool being anchored at any axial position in the well bore.

The anchor mechanism may be resettable for positioning and gripping the well bore, casing or downhole tubular at multiple axial locations within the well bore.

The anchor mechanism may be set to prevent accidental release of the anchor mechanism. The anchor mechanism may be set by providing an upward force or tension to the tool. The upward force or tension to the set the anchor mechanism may range from 2,000 lbs to 15,000 lbs. Preferably the upward force or tension to the set the anchor mechanism is 10,000 lbs.

The tension or pulling force may wedge or lock the slips between the surface of the cone of the tool and the well bore, casing or downhole tubular. The anchor mechanism may be unset by applying a downward force to the tool.

By setting the anchor mechanism the fluid pressure may be reduced below the pre-set threshold flow rate or stopped without the anchor mechanism being deactivated. This may facilitate subsequent integrity pressure testing.

The anchor mechanism may be resettable or reversibly set for gripping on the inside diameter of a first section of well bore, casing or downhole tubular wherein the anchor mechanism may be released and reset inside a second section of well bore, casing or downhole tubular to allow multiple integrity test to be performed during the same trip in the well.

Preferably the packer assembly is a tension-set packer. In this way, the packer can be set by pulling the string against the anchor mechanism to set the packer so that a formation in the wellbore is not required and neither is rotation of the work string required to set the packer.

The packer assembly may comprise a mandrel or sleeve which is configured to be axial moveable relative to the tool body. Preferably mandrel or sleeve is axial moveable relative to the tool body.

An upward force or tension applied to the drill string axial may move the mandrel or sleeve relative to the tool body. The axial movement of the mandrel or sleeve relative to the tool body in a first direction may actuate the packer assembly. The axial movement of the mandrel or sleeve relative to the tool body in a second direction may de-actuate the packer assembly.

Preferably the packer assembly comprises at least one packer element. The packer element may be made from any material capable of radially expanding when it is axially compressed such as rubber.

The upward force or tension required to the set the packer assembly may range from 20,000 lbs to 80,000 lbs. Preferably the upward force or tension to the set the packer assembly is 30,000 lbs.

The axial movement of the mandrel or sleeve relative to the tool body in a first direction radially expands the packer element. The radially expansion of the packer element may seal the well bore. The axial movement of the mandrel or sleeve relative to the tool body in a second direction radially contracts the packer element.

Preferably the packer assembly comprises at least one port configured to be in fluid communication with the annulus of the well bore, casing and/or downhole tubular. The at least one port may be configured to allow fluid communication between the through bore of the tool and the annulus of the well bore, casing and/or downhole tubular below the packer assembly.

The axial movement of the mandrel or sleeve relative to the tool body in a first direction may open the at least one port. The axial movement of the mandrel or sleeve relative to the tool body in a second direction may close the at least one port.

Preferably, the integrity testing tool includes a drill. In this way, drilling can be undertaken on the same trip into the well bore as an integrity test. Preferably the drill is located below the anchor mechanism. More preferably, the drill is operated by rotation of the work string with the tool in the first configuration. The work string may therefore be considered as a drill string.

Preferably, the integrity testing tool includes a bypass flow path around the anchor mechanism and wherein the bypass flow path is selectively operable.

The anchor mechanism may comprise a second sleeve configured to move between a first position and a second position. In the first sleeve position the second sleeve may open or unblock at least one port in the anchor mechanism to allow the actuation of the anchor mechanism. In the second sleeve position the second sleeve may close or unblock at least one port in the anchor mechanism to prevent the actuation of the anchor mechanism. In the second sleeve position the second sleeve may be configured to open the bypass flow path.

The second sleeve may be axially movable from the first position to the second position in response to a dropped ball.

This may allow the fluid pressure through the tool to be increased above the threshold pressure of the anchor mechanism without actuating the anchor mechanism. This may be beneficial after performing an integrity test where a subsequent operation, such as drilling, is required with a high fluid flow rate through the tool to actuate the further tool e.g. drill.

Preferably, the integrity testing tool includes a cutter. In this way, once the position of a leak is detected, the tubular can be cut below this point and the tubular removed. The anchor mechanism may be used as a spear to pull the cut tubular from the well bore.

The integrity testing tool may include a bridge plug. In this way, a seal can be formed in the tubular which can be used to perform an integrity test on the tubular between the plug and the packer assembly.

According to a second aspect of the invention there is provided a method of pressure integrity testing a well bore comprising the steps:

(a) providing an integrity testing tool according to the first aspect;

(b) operating the tool in the first configuration with:

the packer assembly and the anchor mechanism being unset; and operating a further tool on the work string via rotation of the work string through the tool;

(c) operating the tool in the second configuration by:

actuating the anchor mechanism to grip a section of a well bore; and pumping fluid through the tool and up an annulus between the tool and a tubular in the well bore; and (d) operating the tool in the third configuration by:

actuating a packer assembly to seal the well bore; and monitoring at surface for pressure changes in the fluid indicative of loss of integrity.

The method may comprise integrity testing a casing and/or downhole tubular located in a well bore.

The method may comprise performing a negative and/or positive pressure integrity test. The method may comprise performing pressure integrity testing in a casing and/or downhole tubular located in a well bore.

The method may comprise hydraulically or pneumatically actuating the anchor mechanism. The method may comprise mechanically setting the actuated anchor mechanism. The method may comprise setting the anchor mechanism by providing an upward force or tension to the tool. The upward force or tension to the set the anchor mechanism may range from 2,000 lbs to 15,000 lbs. Preferably the upward force or tension to the set the anchor mechanism is 10,000 lbs.

The method may comprise mechanically setting the packer assembly. The method may comprise setting the packer assembly by providing an upward force or tension to the tool. The upward force or tension to the set the anchor mechanism may range from 20,000 lbs to 80,000 lbs. Preferably the upward force or tension to the set the packer assembly is 30,000 lbs. As the tension to set the packer assembly is greater than the tension to set the anchor mechanism, the anchor mechanism can be set without setting the packer mechanism.

Preferably, the method includes the step of assessing the integrity test in the well bore. In this way, further action can be taken dependent on the result on the same trip in the well bore.

The method may comprise injecting cement between the well bore and the casing or downhole tubular if the integrity test indicates leaking or degradation. The method may include the partial replacement of the casing or downhole tubular if the integrity test indicates leaking or degradation.

The method may comprise moving the integrity testing tool to a second position in the well bore and undertaking steps (c) and (d). Preferably, this second integrity test is repeated at shallower locations in the well until loss of integrity is determined.

Step (a) may be operating a drill. The drill may be used to continue drilling the formation to extend the wellbore in the drilling phase. Alternatively, the drill may be used to dress-off a cement plug in a plug and abandonment procedure prior to performing the well integrity test.

Step (a) may be by inserting a bridge plug in a tubular in the well bore. In this way, the integrity test can include testing the bridge plug.

Step (a) may be repeated after step (d) to operate a further tool on the work string by rotation of the work string through the tool. In this way, a cutter can be operated while being supported by the anchor mechanism.

Preferably, the method is performed in a single trip in the well bore. More preferably the steps of dressing-off a cement plug, cutting and pulling a section of the tubular are also performed on the same trip in the well bore.

The method may comprise permanently deactivating the anchor mechanism to prevent the reactivation of the anchor mechanism to grip from the section of a well bore. The method may comprise circulating flow at different rates through tool to control the actuation of the further tool.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

The integrity testing tool is used in a well borehole lined with a well casing or tubular. It will be appreciated that this is only an example use and the tool may be used in other applications such as well bore without well casings or tubulars.

Figure 1:
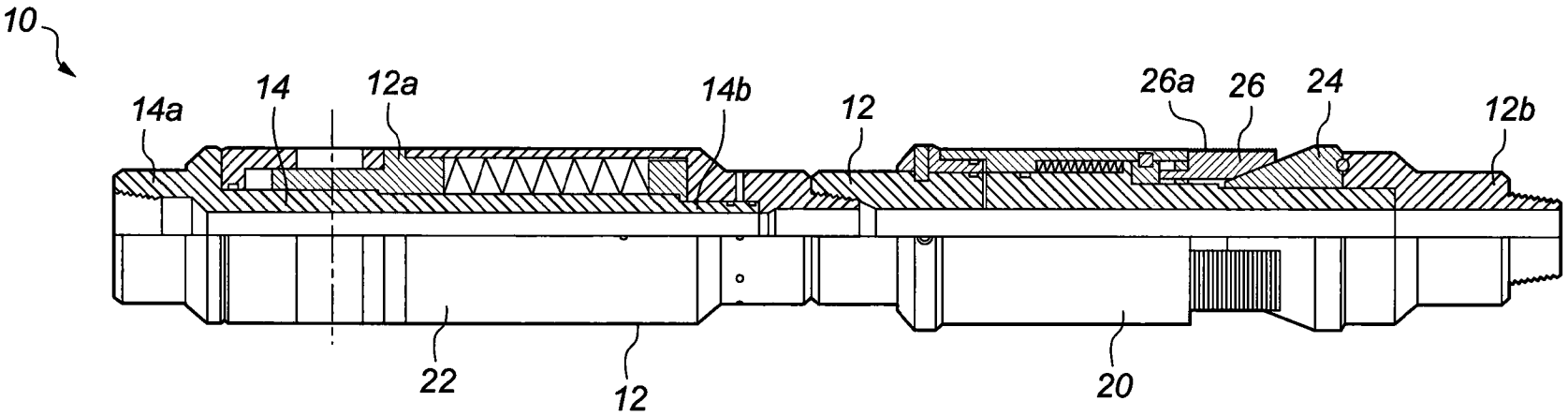
FIG. 1 is a longitudinal part sectional view through the integrity testing tool in a run-in state according to an embodiment of the invention.

FIG. 1 is a longitudinal part sectional view of an integrity testing tool 10 in accordance with a first embodiment of the invention. The tool 10 has an elongate body 12 and a mandrel 14.

A first end 14*a* of the mandrel 14 is configured to be coupled to an upper tool string such as an upper drill string (not shown). The second end 14*b* of the mandrel is axially movably mounted in the body 12.

A first end 12*a* of the body 12 surrounds a portion of mandrel 14. The second end 12*b* of the body is configured to be coupled to a lower tool string such as a lower drill string (not shown). The lower tool string may be connected to drill located further downhole. The second end 12*b* of the body is designed for insertion into a downhole tubular first.

The tool body 12 comprises an anchor mechanism 20 to secure the tool within the well bore casing and a packer assembly 22 configured to seal the well bore.

Figure 2A:
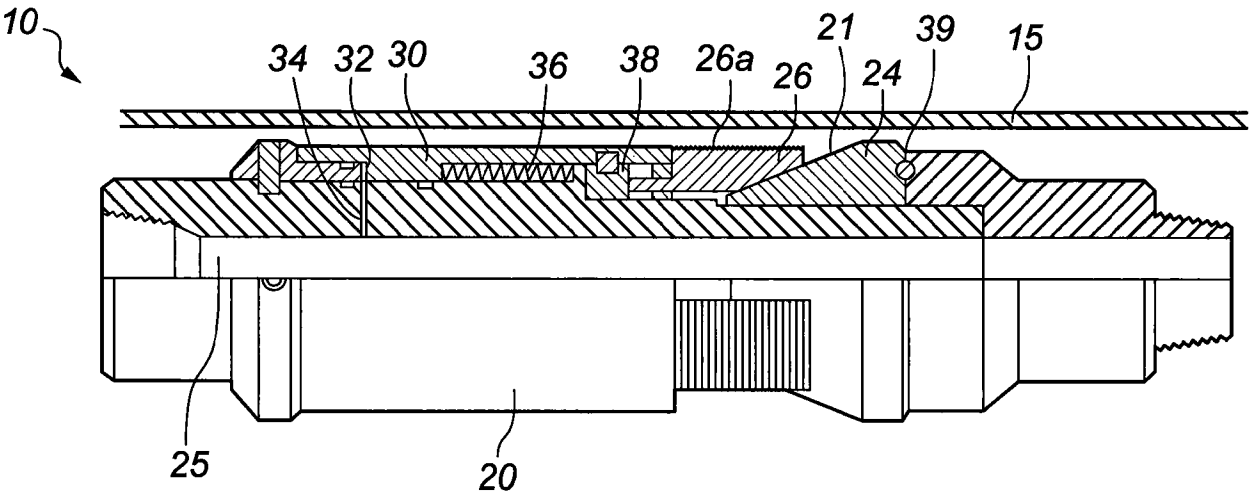
FIG. 2A is an enlarged sectional view of the anchor mechanism of FIG. 1 in a run-in state.
Figure 2B:
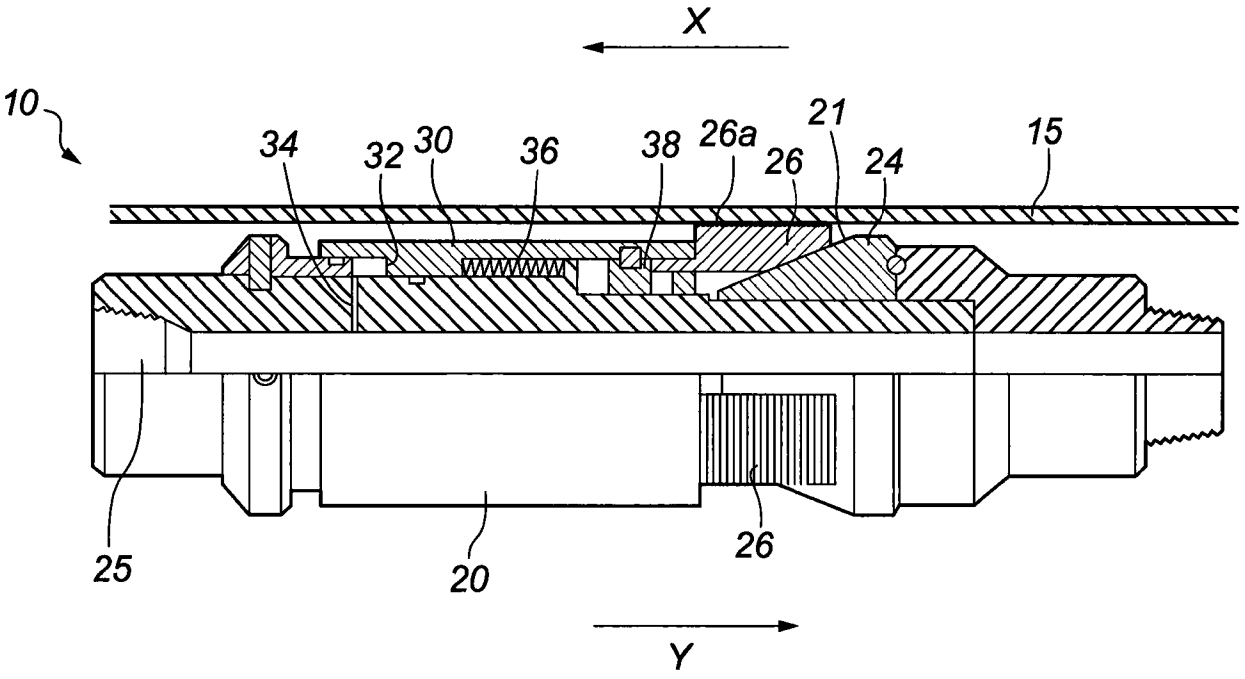
FIG. 2B is an enlarged sectional view of the anchor mechanism of FIG. 1 in an operational state.

FIGS. 2A and 2B are enlarged longitudinal sectional view of the anchor mechanism 20. The anchor mechanism 20 comprises a cone 24 circumferentially disposed about a section of the downhole tool 10. A plurality of slips 26 are configured to move along the surface of the cone 24. The slips 26 have a grooved or abrasive surface 26*a* on its outer surface to engage and grip the casing.

The slips 26 are configured to move between a first position shown in FIG. 2A on the cone 24 in which the slips 26 are positioned away from surface of the casing, and a second position in which the slips 26 engage the surface of the casing as shown in FIG. 2B.

The slips 26 are connected to a sleeve 30. The sleeve 30 is movably mounted on the body 12 and is biased in a first position by a spring 36 as shown in FIG. 2A. It will be appreciated that any spring, compressible member or resilient member may be used to bias the sleeve in a first position.

The tool 10 comprises a bore 25 through which fluid is configured to be pumped. A shoulder 32 of the sleeve 30 is in fluid communication with the main tool bore 25 via a flow path 34. The sleeve 30 is configured to move from a first sleeve position shown in FIG. 2A to a second fluid position shown in FIG. 2B when fluid is pumped into bore 25 above a pre-set circulation threshold through flow path 34 to apply fluid pressure to shoulder 32 of the sleeve 30.

A bearing 39 on the tool body 12 connects the anchor mechanism 20 with tool body. The anchor mechanism 20 is rotatably mounted on the body and is configured to secure the tool against the well bore casing. An upward force applied to the tool body 12 may also apply pressure to the bearing 39 and may facilitate the rotation of lower tool body 12*b* and a drill connected to the lower tool body 12*b*.

Figure 3A:
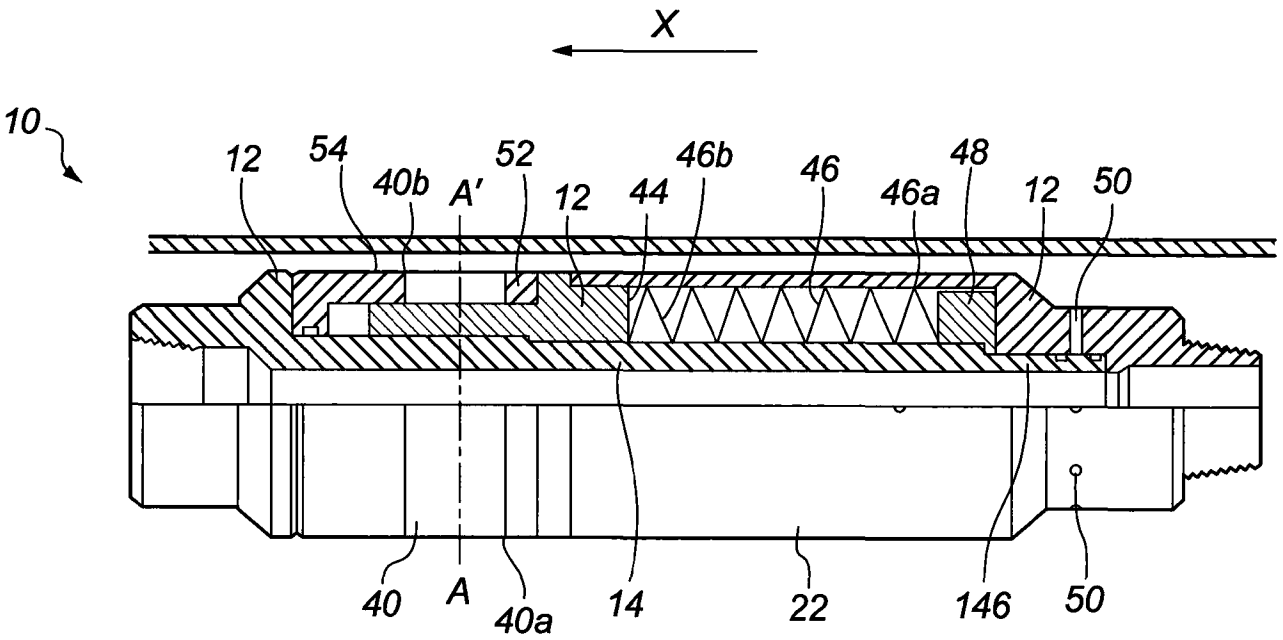
FIG. 3A is an enlarged sectional view of the packer assembly of FIG. 1 in a run-in state.
Figure 3B:
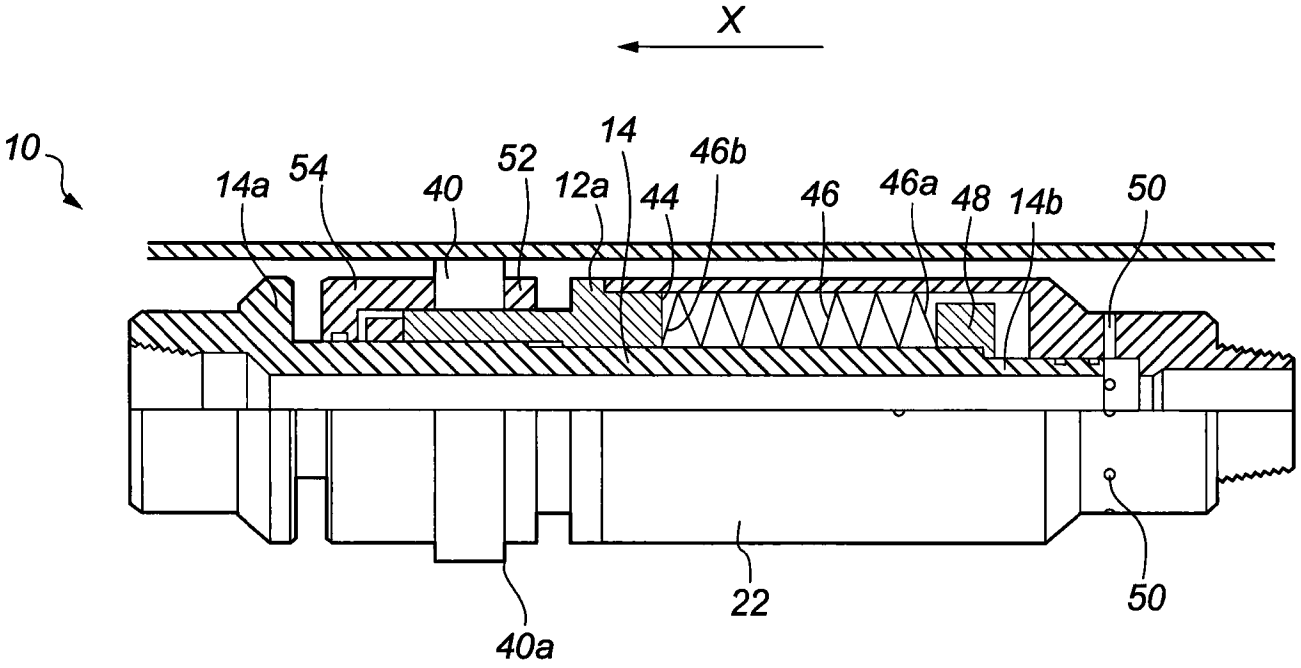
FIG. 3B is an enlarged sectional view of the packer assembly of FIG. 1 in an operational state.
Figure 3C:
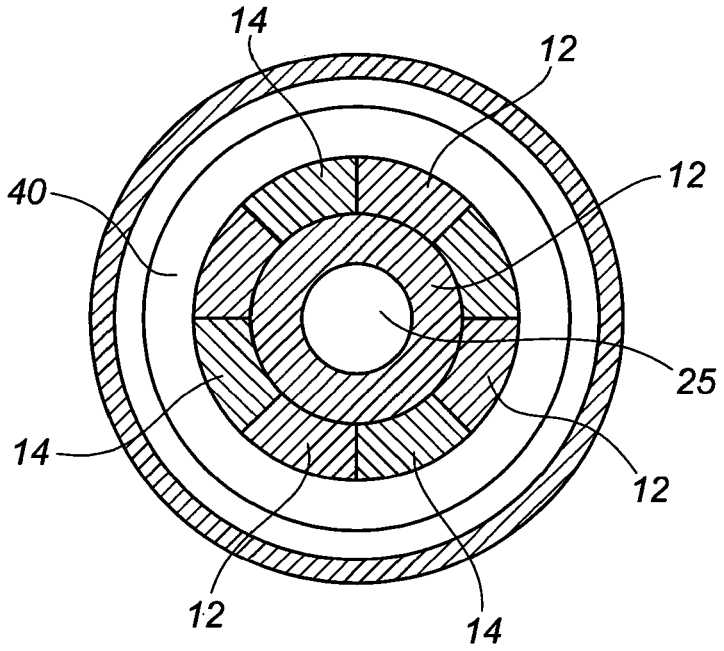
FIG. 3C is an enlarged sectional view of sections A to A' of the packer assembly of FIG. 3A.

FIGS. 3A and 3B are enlarged longitudinal sectional view of the packer assembly 22. FIG. 3C shows a cross-section view of line A-A' of FIG. 3A. The packer assembly 22 comprises a packer element 40. The packer element 40 is typically made from a material capable of radially expanding when it is axially compressed such as rubber.

The mandrel 14 is movable in relation to the body 12. A spring compression ring 48 is mounted on the second end 14*b* of the mandrel. The spring compression ring 48 is configured to engage a first end 46*a* of spring 46. The second end 46*b* of the spring 46 is connected and/or engages shoulder 44 on the tool body 12. The mandrel is movably mounted on the body 12 of the tool 10 and is biased to a first position shown in FIG. 3A by spring 46.

The mandrel is configured to move from a first mandrel position shown in FIG. 3A to a second mandrel position shown in FIG. 3B when an upward tension or force is applied to the tool 10 via the work string.

In the first mandrel position ports 50 are blocked by the second end 14*b* of the mandrel. In the second sleeve position ports 50 are open and in fluid communication with the annulus below the packer element 40.

In the first mandrel position the spring force of spring 46 maintains the position of the mandrel 14 relative to the body 12. The packer element 40 is not compressed and ports 50 are covered by the mandrel.

In the second mandrel position the mandrel 14 moves relative to the body, the upward force acting on the tool 10 and mandrel moves the spring compression ring 48 in a direction X which compresses the spring 46. A lower gauge ring 52 mounted on the mandrel 14 engages a first edge 40*a* of the packer element 40. An upper gauge ring 54 mounted on the tool body engages a second edge 40*b* of the packer element.

An upward force acting on the tool 10 moves the lower gauge ring 52 toward the upper gauge ring 54 compressing the packer element 40. Compression of the packer element 40 causes it to radially expand to contact the casing and seal the annulus of the well bore.

The above-example describes a tension-set packer assembly. However, it will be appreciated that other packer assembly types may be used including compression set or hydraulically set packers.

The upward force or tension applied to the tool has a pre-set lower threshold such that the spring force of spring 46 is overcome when upward force or tension is applied above the lower threshold. The lower threshold may be the minimum force or tension required to overcome the spring force of spring 46. The lower threshold may be adjustable to change the minimum force or tension required to overcome the spring force of spring 46.

The anchor mechanism is configured to hold and maintain the position of the tool in the well bore whilst the packer assembly is actuated and/or the integrity testing tool is performed.

Operation of the apparatus will now be described with reference to FIGS. 1 to 3C.

In FIG. 1, the integrity test tool 10 is shown in a deployment phase, with an anchor mechanism 20 in a first position and a packer assembly in a retracted storage position. The packer assembly is located above the anchor mechanism when deployed in the well bore. The second end 12*b* of the body 12 is configured to be connected to a drill via a lower drill string (not shown) located further downhole in the well bore. The tool 10 in the deployment phase is lowered in the downhole to a desired position in the well bore.

Fluid circulation through the tool below a pre-set threshold actuates the drill without actuating the anchor mechanism in the integrity test tool 10. This may be considered as the tool operating in the third configuration.

When an integrity test is to be performed the anchor is hydraulically actuated to grip the well bore or casing surface to secure the axial position of the tool 10 in the well bore. The fluid circulation rate through bore 25 is increased above the pre-set threshold rate. Fluid flows through flow path 34 and acts on shoulder 32 of the sleeve 30 in the anchor mechanism 20. The pre-set threshold is set by the spring force of spring 36. In this example, the first pre-set threshold is 250 gallons per minute (gpm).

The fluid pressure of the fluid above the pre-set threshold overcomes the spring force of spring 36. The sleeve 30 moves along the longitudinal axis of the tool body 12 to the second position shown in FIG. 2A. A slip retaining ring 38 is secured to the sleeve 30 and is connected to the slips 26. The sleeve 30 and slip retaining ring 38 push the slips 26 along the slope 21 of cone 24.

The slips 26 extend outward and engage the surface of casing 15. The slips provide friction to maintain the position of the tool 10 within the casing. This may be considered as the tool operating in the first configuration.

Optionally, the axial position of the tool in the well bore is maintained by reversibly setting the anchor mechanism 20. To set the anchor mechanism an upward tension or pulling force is applied to the drill string as shown by arrow X in FIG. 2B. In this example 10,000 lbs upward tension or pulling force is applied to set the anchor, although it will be appreciated that the anchor mechanism may be configured to set at different tension or pulling forces.

The tension or pulling force causes the slips to be wedged or locked between the surface of the cone 24 of the tool and the casing 15 of the well bore. At this point the tool will remain at this location even if the fluid pressure in the bore 25 is stopped or reduced below the pre-set threshold.

If the anchor mechanism 20 is not set the anchor mechanism reverts to its first position shown in FIG. 2A when the fluid pump is stopped or fluid pressure is reduced below the pre-set threshold. The spring force of spring 36 moves the sleeve 30 to the first position shown in FIG. 2A. The slips 26 which are in contact with the slip retaining ring 38 are pulled along the slope 21 of cone 24 and moved away from the surface of casing 15.

Once the anchor mechanism 20 has engaged the casing and is set, a positive and/or negative integrity pressure test may be performed.

To perform a positive integrity pressure test the packer assembly is first set to seal the well bore. To set the packer an upward tension or pulling force is applied to the drill string as shown by arrow X in FIG. 3A. In this example 60,000 lbs of upward tension or pulling force is applied to the drill string.

The axially position of the tool body 12 in the well bore is maintained by the anchor mechanism 20 gripping the casing. The mandrel 14 connected to the upper drill string is moved to a second position shown in FIG. 3B by the upward tension or pulling force. The lower gauge ring 52 mounted on the mandrel 14 engages a first edge 40*a* of the packer element resulting in axial compression of the packer element between lower gauge ring 52 mounted on the mandrel 14 and upper gauge ring 54 mounted on the tool body. As the packer element is axially compressed it radially expands to engage the casing and seals casing annulus. The upward force is maintained to seal of the well bore. This may be considered as the second configuration.

Ports 50 in the mandrel are opened allowing fluid communication between the bore 25 and the annulus below the packer assembly.

The annulus is now sealed off and a positive pressure can be applied down the drill string to test the well for leaks anywhere below the packer assembly. When the required test pressure is reached the pressure is monitored for a pre-determined amount of time in order to determine whether a pressure drop is observed which is indicative of a leak.

On completion of successful pressure testing the upward force or tension applied to the drill string is reduced to allow the spring 46 to move the mandrel 14 to a first position shown in FIG. 3A. The packer element returns to its original uncompressed state and moves away from the well casing 15.

To unset and release the anchor mechanism a downward force is applied in the direction shown as "Y" in FIG. 2B which momentarily moves the cone 24 away from the slips 26 which is sufficient to allow the spring force of the spring 36 to pull the slips 26 along the slope 21 of the cone and away from the casing to the first position shown in FIG. 2A.

The tool may be relocated to a new axial position in the well bore and the anchor mechanism may grip the casing as described above and another integrity test performed.

To perform a negative inflow pressure test, after the anchor is set as described above. A low density fluid is pumped into the string to create a pressure underbalance. As an example a desired pressure underbalance may be 3000 PSI.

The packer assembly 22 is then set by applying an upward tension or pulling force to the drill string as shown by arrow X in FIG. 3A. In this example 60,000 lbs is applied to the drill string.

The axially position of the lower tool body 12*b* in the well bore is maintained by the anchor mechanism 20 gripping the casing. The mandrel 14 is moved to a second position by the upward tension or pulling force. The lower gauge ring 52 mounted on the mandrel 14 engages a first edge 40*a* of the packer element resulting in axial compression of the packer element against the upper gauge ring 54 mounted on the tool body 12. As the packer element is axially compressed it radially expands to engage the casing and seals casing annulus. The upward force is maintained to maintain the seal of the well bore.

The annulus is now sealed and the surface pressure is bled off and the open drill string at surface is monitored to see if there is any inflow of fluids. Any inflow will flow through one or more nozzles on the drill bit or through ports 50 on the packer assembly.

On completion of a successful negative pressure test, the drill string is re-pressured to the previous pressure level. The packer is unset by reducing the upward force to allow the spring 46 to move the mandrel 14 to a first position shown in FIG. 3A. The packer element 40 returns to its original position and moves away from the well casing 15.

The anchor mechanism is unset by providing a downward force in the direction shown as "Y" in FIG. 2B which momentarily moves the cone 24 away from the slips 26 which is sufficient to allow the spring force of the spring 36 to pull the slips 26 along the slope 21 of the cone and away from the casing to the first position shown in FIG. 2A.

The low density fluid can be reverse circulated out of the well and drilling operations can commence or be resumed.

The tool may be relocated to a new axial position in the well bore and the anchor mechanism may grip the casing as described above and another integrity test performed. The above process may be carried out multiple times and at various positions in the casing.

If the integrity test is successful it may provide an indication that the casing and/or cement bond in the well bore below the testing tool is adequate and the plug and abandonment operation may continue.

In the event that an inflow or outflow of fluid is detected, it is indicative that the casing and/or cement bond is unacceptable. In this case cement must be injected between the casing the well bore to create a new cement bond to improve the integrity of the well bore. After the cement is set the integrity test is repeated to test the quality of the new cement bond.

Figure 4A:
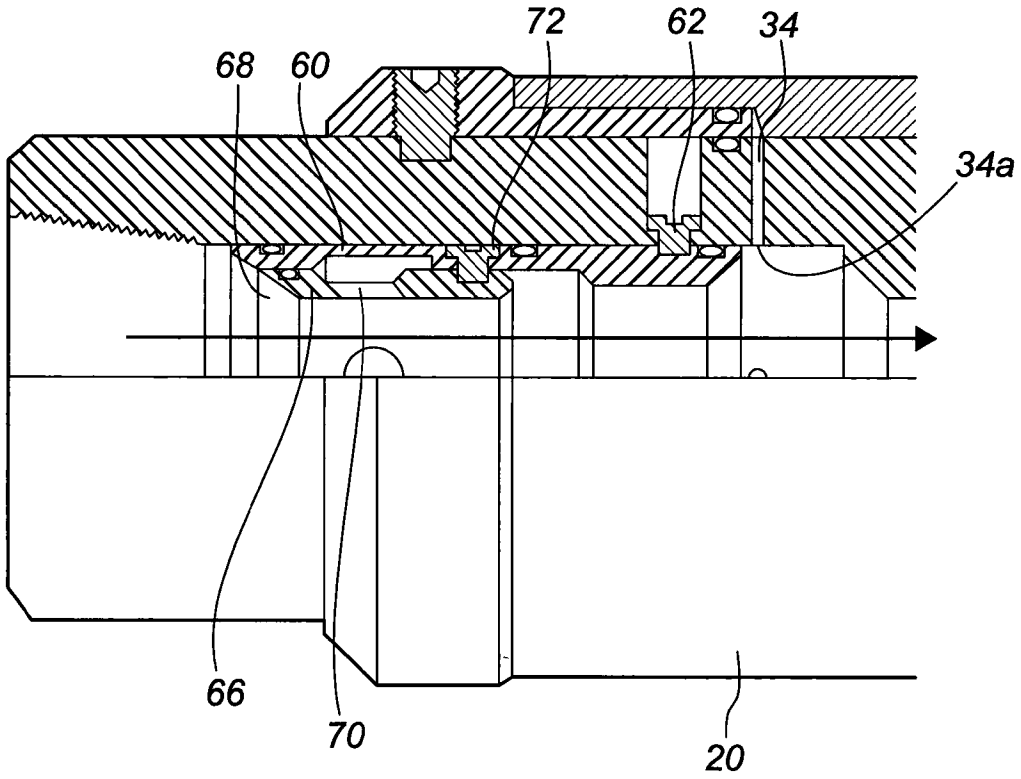
FIG. 4A is an enlarged sectional view of the anchor mechanism of FIG. 1 in a run-in state according to an embodiment of the invention FIG. 4B an enlarged sectional view of the anchor mechanism of FIG. 4A in an operational state.
Figure 4B:
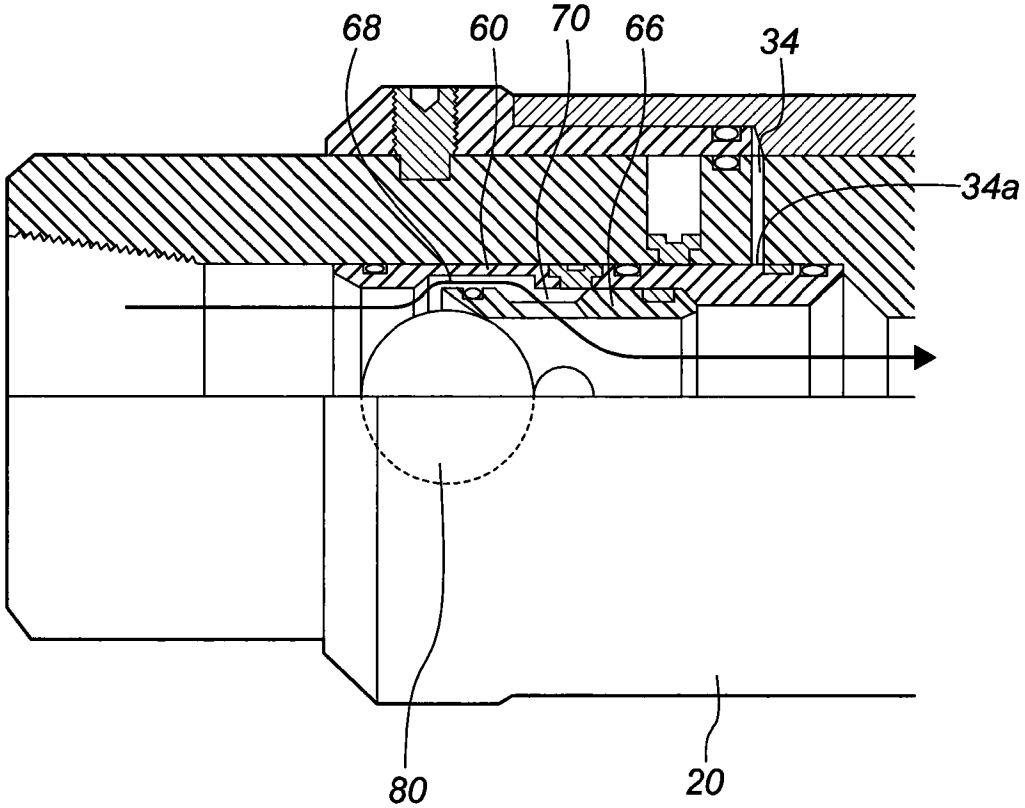

Optionally or additionally the anchor mechanism 20 is provided with an internal sleeve 60 as shown in FIGS. 4A and 4B. Internal sleeve 60 is held in a first position by a shear screw 62. In the first sleeve position shown in FIG. 4A ports 34*a* on body 12 are open allowing fluid to flow into flow path 34. In a second sleeve position shown in FIG. 4B the sleeve 60 blocks the ports 34*a* preventing fluid into or flow out of flow path 34.

The internal sleeve 60 when in the second position prevents actuation of the anchor mechanism 20. This may allow the fluid pressure to be increased above the threshold pressure of the anchor mechanism 20 without actuating the anchor mechanism. This may be beneficial after performing an integrity test a subsequent drilling operation is required with a high fluid flow rate through the tool to actuate the drill.

The internal sleeve 60 is operated by a dropped ball actuation. A bypass sleeve 66 has a ball seat 68 configured to receive a dropped ball. The bypass sleeve 66 has a port 70 and is secured to the internal sleeve 60 by a shear screw 72.

To prevent the anchor mechanism 20 from being actuated a ball 80 is dropped in the bore of the drill string and is carried by fluid flow through bore 25 until it is retained by the ball seat 68. Once the ball 80 has engaged the ball seat 68 the ball 80 prevents fluid flow in the bore 25. Fluid pressure applied to the ball and ball seat shear screws 62 and 72 and moves bypass sleeve 66 and internal sleeve 60 to their second sleeve positions shown in FIG. 4B.

In the second sleeve position, the internal sleeve 60 blocks flow path 34 preventing fluid from acting on sleeve 30 and actuating the anchor mechanism. In the second position, the bypass sleeve opens a port 70 allowing fluid to bypass the ball 80 and continue through bore 25 to actuate the drill.

In order to relocate the integrity testing tool to a different axial position in the well bore the fluid pressure pumped into bore 25 is stopped or reduced. The absence or reduction of fluid pressure below the threshold pressure causes the spring force of spring 36 to act on sleeve 30 to move the sleeve to the first position shown in FIG. 2A. However, the spring force of spring 36 may not be sufficient to move the slips 26 which are located in a set position locked between the compressive forces of the casing and the cone 24.

To unset and release the slips 26 a downward force is applied in the direction shown as "Y" in FIG. 2B which momentarily moves the cone 24 away from the slips 26 which is sufficient to allow the spring force of the spring 36 to pull the slips 26 along the slope 21 of the cone and away from the casing to the first position shown in FIG. 2A.

The downhole tool may be relocated to a new axial position in the well bore and the anchor mechanism actuated to grip the casing as described above and another integrity test performed.

Reference is now made to FIGS. 5A to 5H which provide schematic illustrations of a method of pressure integrity testing in a wellbore. Like parts to those in FIGS. 1 to 4 have been given the same reference numeral to aid clarity. Each Figure shows a well bore 18 in which is located a tubular such as casing 15. A plug 82 is positioned in the casing 15. The plug 82 can be inserted using the work string 84 shown in FIG. 5A including an integrity testing tool according to an embodiment of the present invention. In this case the plug 82 will be a bridge plug. Alternatively, as is shown in FIGS. 5A-H, the plug is a cement plug 82 which is already present in the casing 15.

Figures 5A, 5B, 5C, 5D, 5E, 5F, 5G, 5H:
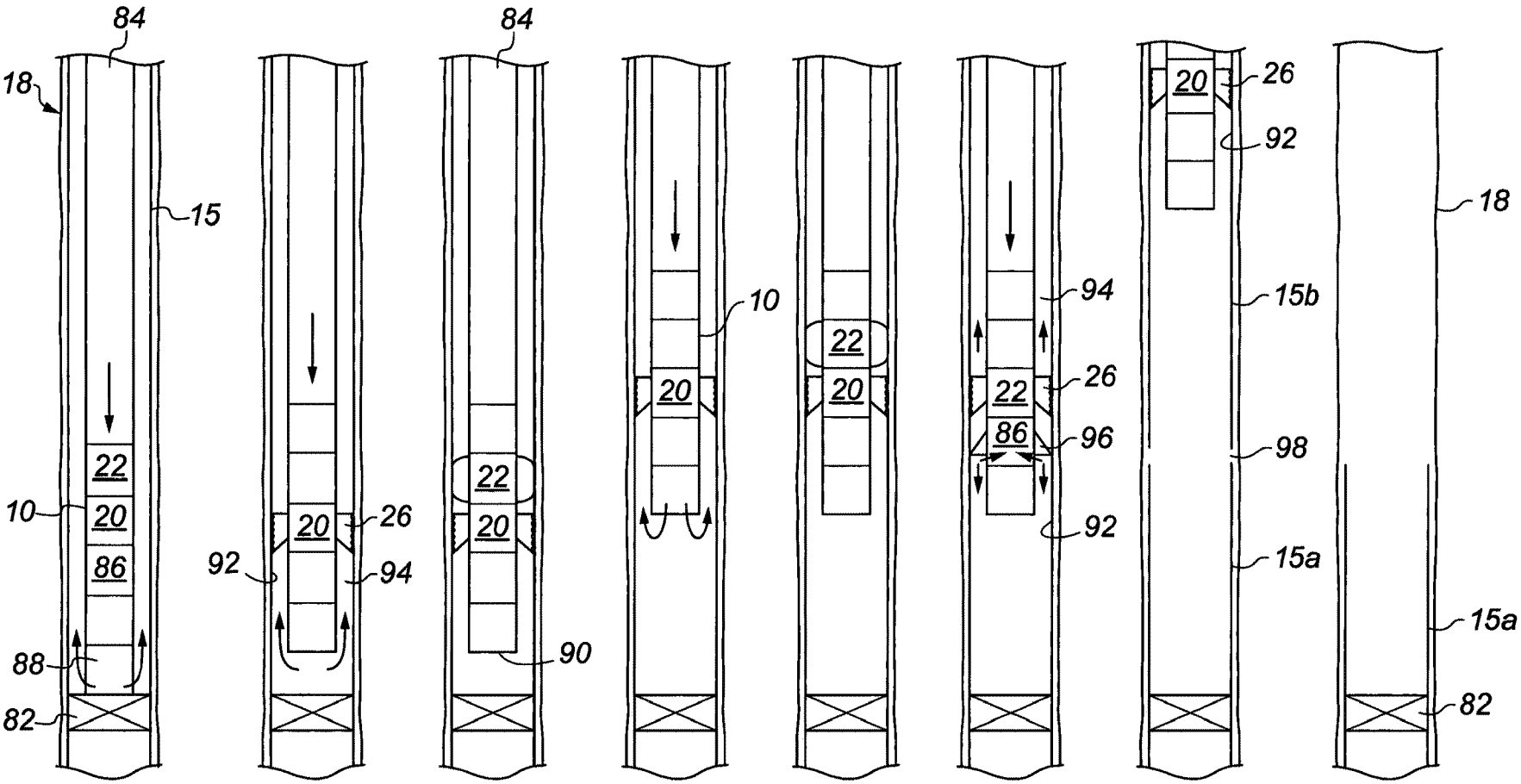
FIGS. 5A to 5H provide schematic illustrations of a method of pressure integrity testing of a well bore according to an embodiment of the present invention.

Referring initially to FIG. 5A of the drawings there is illustrated an integrity testing tool, generally indicated by reference numeral 10, run into a well bore 18 which is lined with casing 15 or other tubular. Integrity testing tool 10 includes, from a first end 12*a*, an anchor mechanism 20 and a packer assembly 22 arranged on a drill string 84 or other tool string according to an embodiment of the present invention. The anchor mechanism 20 is arranged below the packer assembly 22. Also arranged on the string are a cutting mechanism 86 arranged below the anchor mechanism 20 and a drill bit 88 arranged below the cutting mechanism 86 at the lower end 90 of the string 84.

The anchor mechanism 20 and packer assembly 22 may be formed integrally on a single tool body or may be constructed separately and joined together by box and pin sections as is known in the art. Additionally the cutting mechanism 86 may be formed integrally on the single tool body or may be constructed separately and joined together by box and pin sections as is known in the art. Two parts may also be integrally formed and joined to the third part.

Referring to FIG. 5A of the drawings, the integrity test tool 10 is run-in the wellbore 18 and casing 15 until it reaches the cement plug 82. At this point, the string 84 can be rotated from surface and fluid can be pumped at a fluid pressure below a pre-set threshold through the bore of the drill string 84 to hydraulically activate the drill 88. This represents a first configuration with the cutting mechanism 86, anchor mechanism 20 and packer assembly 22 all held in inactive positions. Weight can be set down upon the string 84 to operate the drill 88 and the drill 88 is used to dress the cement plug 82.

Referring now to FIG. 5B, the anchor mechanism 20 is now set as described hereinbefore with reference to FIGS. 2A and 2B. The anchor slips 26 engage an inner surface 92 of the casing 15. At this stage fluid can be pumped into the well bore by pumping through the bore 25 of the tool 10 and circulating the fluid up the annulus 94 between the string 84 and the inner surface 92 of the casing 15. In this way the desired fluid required to perform a wellbore pressure integrity test is delivered to a location below the packer assembly 22 to be tested. This is considered as the second configuration.

With the fluid in place, the packer assembly 22 is set as described hereinbefore with reference to FIGS. 3A and 3B. A positive pressure test can be performed as described above. Alternatively or additionally a negative pressure can be performed. It will be realised that the packer assembly 22 can be unset and re-set to allow circulation of fluids between each test. This testing is illustrated in FIG. 5C and is the third configuration.

With the string 84 remaining in the well bore 18, the results of the integrity test can be determined at surface. If no leaks are determined then the integrity of the cement plug 82 and that portion of casing 15 below the location of the packer assembly 22 has been proven. The packer assembly 22 and anchor mechanism 20 are now unset and can be moved to a shallower location in the wellbore for the integrity test to be performed over a greater section of casing 15. Thus the axial position of the tool 10 is changed in the well bore. It is noted that this is illustrated in FIGS. 5D and 5E and that the casing 15 has the same internal diameter at both testing locations. Thus by moving up a length of casing 15 an entire casing section can be integrity tested. When a leak is determined and the integrity fails, the operator will know that the leak occurred in the last portion of casing added to the test. The user will then position the work string 84 so that the cutting mechanism 86 is arranged below the position of the packer assembly 22 for the previous test so that a cut can be made to leave only proven integrity tested casing 15 below the cut position.

At the cutting position, illustrated in FIG. 5F, the anchor is re-set so as to stabilise the cutter blades 96. A ball 80 may be dropped through the bore 25 to actuate the cutting mechanism 86, thereby allowing the string 84 to rotate through the tool 10 and be transmitted to below the anchor mechanism 20. This is as illustrated in FIGS. 4A and 4B. A cut 98 is made through the casing 15 to provide separate upper 15*a* and lower 15*b* sections of casing 15. As the packer assembly 22 is unset, circulation can occur during cutting to help cool the cutter blades 96 and remove swarf created from the cutting site. This may be considered as the first configuration again. Once the cut is made, a circulation test can be performed, if desired, to check that the upper casing section 15*b* is free.

The cutting mechanism 86 and the anchor mechanism 20 are disengaged from the inner surface 92 of the casing 15 and the string 84 is pulled so that the tool 10 is now relocated to a new axial position in the casing 15 with the anchor mechanism 20 located at an upper end of the cut section of casing 15*b*. In this position the anchor mechanism 20 is activated to grip the casing section 15*b* as described above and as illustrated in FIG. 5G.

By pulling the drill string 84, the anchor mechanism 20 acts as a casing spear and the cut section of casing 15*b* is removed from the well bore 18. The well bore 18 now contains the integrity tested casing stub 15*a* and the cement plug 82 as shown in FIG. 5H. If desired cement can be pumped into the well bore 18 in the knowledge that the arrangement has sufficient integrity and there are no leaks. The well can therefore be abandoned.

It is noted that the steps through FIGS. 5A to 5H are all performed on a single trip into the well bore 18. It will be realised that the first step of dressing off the cement plug can be replaced with setting a bridge plug and/or may include tagging the plug. Individually steps may be omitted, or performed in a different order. For example, drilling may occur after the integrity test has been performed. Such an arrangement would be used in a drilling scenario.

Figure 6A:
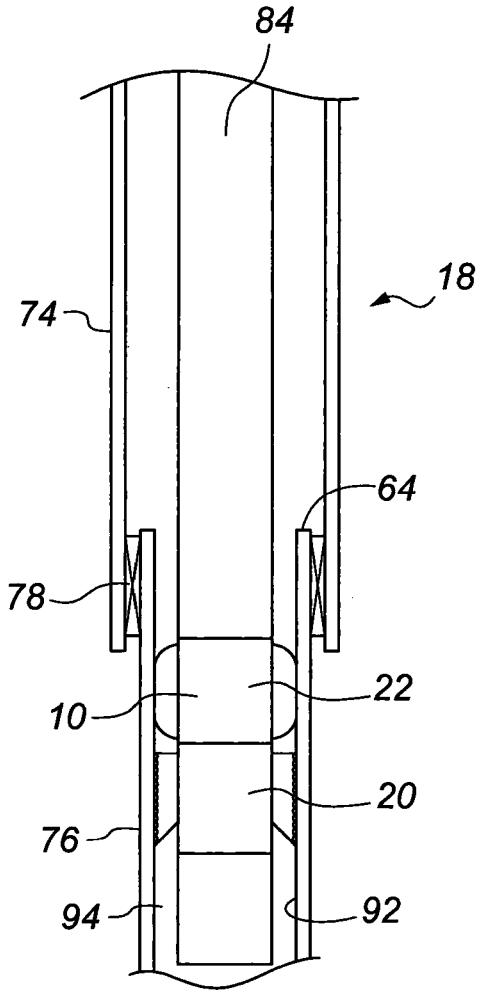
FIGS. 6A and 6B provide schematic illustrations of a method of pressure integrity testing of a well bore according to another embodiment of the present invention.
Figure 6B:
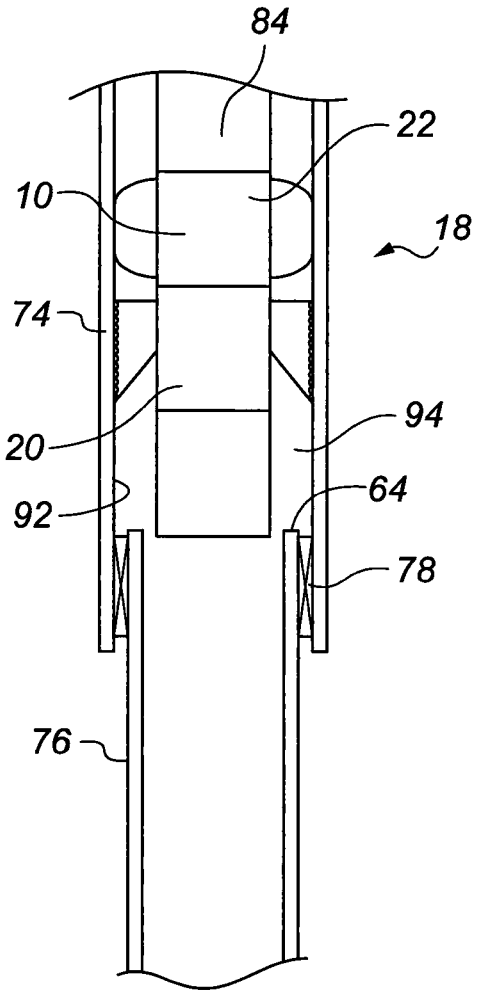

Reference is now made to FIGS. 6A and 6B of the drawings which illustrate a further method of performing pressure integrity testing in a well bore according to a further embodiment of the present invention. Like parts to those in the earlier Figures have been given the same reference numeral to aid clarity. In these Figures the well bore 18 is illustrated having two different sizes of tubulars, an upper casing 74 and a lower casing 76. The casings 74,76 are connected via a liner top hanger 78 as is known in the art. The different casing sizes will be the standard casing sizes known to those skilled in the art these being supplied in standard diameters e.g. 5", 5½", 6", 6⅝" 7", 7⅝", 8⅝", 9⅝", 10¾", 11¾", 13⅜", 14", 16", 18⅝" and 20". Note that we refer to casing sizes by their diameter and these then present a known internal diameter, which differs between each casing size. We are not considering different weights of casing.

In the embodiment shown the lower casing 76 is preferably 9⅝", while the upper casing 74 is preferably 10¾". Work string 84 is shown with the tool 10 located within the lower casing 76 initially at FIG. 6A. Here the well can be pressure integrity tested at locations below the liner top hanger 78. It is noted that the anchor mechanism 20 and the packer assembly 22 can be set to grip and seal against the inner surface 92 of the lower casing 76. Pressure integrity testing can be performed as described herein before. This advantageously illustrates an advantage over the prior art as the top 64 of the lower casing 76 will not set the anchor mechanism 20 and/or the packer assembly 22 as is required in the prior art.

In FIG. 6B, the string 84 has now been pulled above the liner top hanger 78 and thus pressure integrity testing can be performed at the same location as for the prior art. This shows that the present invention can be used over multiple casing diameters where the inner diameter of the casing varies. A specially adapted tool 10 in which the anchor mechanism 20 and the packer assembly 22 can be expanded to contact different standard diameters of casing is required for this to be performed. Such a tool 10 is the TRIDENT system available from the present Applicants. Thus the test tool 10 can be used over different sizes of casing on the same trip in the well bore.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as", "lower", "upper", "above", "below", "up", "down" and the like are used herein to indicate directions and locations as they apply to the appended drawings and will not be construed as limiting the invention and features thereof to particular arrangements or orientations. Likewise, the term "inlet" shall be construed as being an opening which, dependent on the direction of the movement of a fluid may also serve as an "outlet", and vice versa.

The invention provides a downhole integrity testing tool and method of use. The testing tool comprising an anchor mechanism configured to grip a section of a well bore and a packer assembly. The anchor mechanism is configured to be set at different axial positions in the well bore to allow the testing tool to be anchored at different axial positions in the well bore.

The present invention provides a robust and reliable and integrity test tool suitable for performing negative and/or positive pressure testing of a well bore, casing or cement plug. The invention enables the tool to be reversibly set and integrity testing performed at any axial positions in the well bore. The downhole testing tool has improved productivity and efficiency, and is capable of being set at multiple positions in the well bore to reliably perform multiple integrity tests once deployed in the well bore.

A further benefit of the integrity testing tool is that it may be used on a drill string. This may allow integrity testing to be performed prior, during and/or after a downhole drilling operation. The integrity testing and drilling operation may be performed in a single downhole trip such as a drilling operation followed by integrity testing. Additionally, the steps of dress-off, integrity testing, cutting and pulling of casing can be performed in a single downhole trip for well abandonment.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

We claim:

1. A downhole integrity testing tool, the tool comprising:
- a substantially cylindrical assembly having first and second ends adapted for connection in a work string;
- an anchor mechanism configured to grip a section of tubular in a well bore; and
- a packer assembly being settable to create a seal between the tool and the tubular to thereby allow the flow of fluids into a sealed area to perform an integrity test;
- wherein the anchor mechanism is hydraulically actuated, resettable and the tool is configured to operate in:
- a first configuration wherein the anchor mechanism and the packer assembly are unset so that rotation of the work string is transmitted through the tool;
- a second configuration wherein the anchor mechanism is set to grip the tubular and the packer assembly is unset so that fluid may be circulated through the tool without movement of the tool; and
- a third configuration wherein the anchor mechanism and the packer assembly are both set in order to perform an integrity test.

2. The tool according to claim 1 wherein the anchor mechanism that is configured to be reversibly set at different axial positions in the well bore so that the integrity testing tool may be anchored at different axial positions in the well bore.

3. The tool according to claim 1 wherein the anchor mechanism is located below the packer assembly when positioned in the work string.

4. The tool according to claim 1 wherein the anchor mechanism comprises a cone and at least one slip mounted on a tool body, the at least one slip being configured to engage an inner surface of section of tubular.

5. The tool according to claim 4 wherein the anchor mechanism comprises a first sleeve configured to be slidably mounted within the tool body and configured to move the at least one slip between a first position where the at least one slip does not engage the casing and a second position where the at least one slip engages the casing.

6. The tool according to claim 1 wherein the anchor mechanism is settable to prevent accidental release of the anchor mechanism by locking the slips between a surface of the cone of the tool and the tubular on application of tension.

7. The tool according to claim 1 wherein the packer assembly is a tension-set packer.

8. The tool according to claim 7 wherein the packer assembly comprises a mandrel or sleeve which is configured to be axial moveable relative to the tool body so as to radially expand at least one packer element when tension is applied to the tool.

9. The tool according to claim 7 wherein the packer assembly comprises at least one port configured to be in fluid communication with an annulus of the well bore.

10. The tool according to claim 9 wherein the at least one port is opened by axial movement of the mandrel or sleeve relative to the tool body in a first direction may open the at least one port.

11. The tool according to claim 1 wherein the integrity testing tool includes a drill and the drill is located below the anchor mechanism.

12. The tool according to claim 1 wherein the integrity testing tool includes a cutter.

13. The tool according to claim 1 wherein the integrity testing tool includes a bridge plug.

14. A downhole integrity testing tool, the tool comprising:
- a substantially cylindrical assembly having first and second ends adapted for connection in a work string;
- an anchor mechanism configured to grip a section of tubular in a well bore; and
- a packer assembly being settable to create a seal between the tool and the tubular to thereby allow the flow of fluids into a sealed area to perform an integrity test;
- wherein the anchor mechanism is pneumatically actuated, resettable and the tool is configured to operate in:
- a first configuration wherein the anchor mechanism and the packer assembly are unset so that rotation of the work string is transmitted through the tool;
- a second configuration wherein the anchor mechanism is set to grip the tubular and the packer assembly is unset so that fluid may be circulated through the tool without movement of the tool; and
- a third configuration wherein the anchor mechanism and the packer assembly are both set in order to perform an integrity test.

15. The tool according to claim 14 wherein the anchor mechanism is actuated by pumping fluid into a bore in the tool above a pre-set flow rate threshold to move the sleeve.

16. A method of pressure integrity testing a well bore, the method comprising:
- (a) providing an integrity testing tool comprising:
- a substantially cylindrical assembly having first and second ends adapted for connection in a work string;
- an anchor mechanism configured to grip a section of tubular in a well bore; and
- a packer assembly being settable to create a seal between the tool and the tubular to thereby allow the flow of fluids into a sealed area to perform an integrity test;
- wherein the anchor mechanism is resettable and the tool is configured to operate in:

a first configuration wherein the anchor mechanism and the packer assembly are unset so that rotation of the work string is transmitted through the tool;

a second configuration wherein the anchor mechanism is set to grip the tubular and the packer assembly is unset so that fluid may be circulated through the tool without movement of the tool; and a third configuration wherein the anchor mechanism and the packer assembly are both set in order to perform an integrity test;

(b) operating the tool in the first configuration with:

the packer assembly and the anchor mechanism being unset; and operating a further tool on the work string via rotation of the work string through the tool;

(c) operating the tool in the second configuration by:

actuating the anchor mechanism to grip a section of a well bore; and pumping fluid throuah the tool and up an annulus between the tool and a tubular in the well bore;

(d) operating the tool in the third configuration by:

actuating a packer assembly to seal the well bore; and monitoring at surface for pressure changes in the fluid indicative of loss of integrity; and wherein the method is performed in a single trip in the well bore and wherein the steps of dressing-off a cement plug, cutting and pulling a section of the tubular are also performed on the same trip in the well bore.

17. The method according to claim 16 wherein the method comprises performing a negative pressure integrity test.

18. The method according to claim 16 wherein the method comprises performing a positive pressure integrity test.

* * * * *